US009524667B2

(12) United States Patent
In et al.

(10) Patent No.: US 9,524,667 B2
(45) Date of Patent: Dec. 20, 2016

(54) PIXEL AND ORGANIC LIGHT EMITTING DIODE DISPLAY DEVICE USING THE SAME

(71) Applicant: Samsung Display Co., Ltd., Yongin, Gyeonggi-Do (KR)

(72) Inventors: Hai-Jung In, Yongin (KR); Jung-Bae Kim, Yongin (KR); Bo-Yong Chung, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 406 days.

(21) Appl. No.: 14/038,594

(22) Filed: Sep. 26, 2013

(65) Prior Publication Data

US 2014/0333512 A1 Nov. 13, 2014

(30) Foreign Application Priority Data

May 13, 2013 (KR) ..... 10-2013-0053668

(51) Int. Cl.
*G09G 3/30* (2006.01)
*G09G 3/32* (2016.01)

(52) U.S. Cl.
CPC ..... *G09G 3/3233* (2013.01); *G09G 3/3208* (2013.01); *G09G 2300/0819* (2013.01); *G09G 2300/0842* (2013.01); *G09G 2300/0852* (2013.01); *G09G 2300/0861* (2013.01); *G09G 2300/0876* (2013.01); *G09G 2310/0251* (2013.01); *G09G 2310/0262* (2013.01); *G09G 2310/061* (2013.01); *G09G 2320/043* (2013.01); *G09G 2320/045* (2013.01)

(58) Field of Classification Search
CPC ..... G09G 3/3233; G09G 2320/043; G09G 2300/0852; G09G 2310/0251; G09G 3/3208; G09G 2310/061
See application file for complete search history.

(56) References Cited

U.S. PATENT DOCUMENTS

2005/0140605 A1* 6/2005 Jung ..... G09G 3/3233 345/76
2006/0022305 A1* 2/2006 Yamashita ..... G09G 3/2014 257/565
2007/0040786 A1* 2/2007 Chung ..... G09G 3/3233 345/92

(Continued)

FOREIGN PATENT DOCUMENTS

KR 10-2012-0048294 A 5/2012
KR 10-2013-0135506 A 12/2013

*Primary Examiner* — Michael J Eurice
(74) *Attorney, Agent, or Firm* — Knobbe, Martens, Olson & Bear, LLP

(57) ABSTRACT

A pixel circuit for an organic light emitting diode (OLED) display is disclosed. One inventive aspect includes an organic light emitting diode, a first transistor, a storage unit, a second transistor and a third transistor. The first transistor controls the amount of current flowing from a first power source coupled to a second power source via a second node and the organic light emitting diode in response to a voltage at a first node. The storage unit is connected to a data line, and stores a data signal from the data line. The second transistor is connected to a fourth node and the first node and is turned on when a second control signal is supplied. The third transistor is connected to the first node and a third node and is turned on when a third control signal is supplied.

18 Claims, 8 Drawing Sheets

(56) References Cited

U.S. PATENT DOCUMENTS

2007/0273619 A1* 11/2007 Kitazawa ..... G09G 3/3233 345/76
2008/0074357 A1* 3/2008 Kanda ..... G09G 3/3233 345/76
2008/0111804 A1* 5/2008 Choi ..... G09G 3/3233 345/205
2008/0211746 A1* 9/2008 Caligiore ..... G09G 3/3233 345/76
2009/0027310 A1* 1/2009 Kim ..... G09G 3/3233 345/76
2009/0135111 A1* 5/2009 Yamamoto ..... G09G 3/3233 345/76
2009/0201231 A1* 8/2009 Takahara ..... G09G 3/3233 345/76
2009/0219232 A1* 9/2009 Choi ..... G09G 3/3233 345/76
2010/0079419 A1* 4/2010 Shibusawa ..... H01L 27/3272 345/204
2010/0079430 A1* 4/2010 Yamashita ..... G09G 3/3233 345/210
2011/0025671 A1* 2/2011 Lee ..... G09G 3/003 345/211
2011/0279484 A1* 11/2011 Han ..... G09G 3/3233 345/690
2012/0007848 A1* 1/2012 Han ..... G09G 3/3233 345/212
2012/0113077 A1* 5/2012 Kang ..... G09G 3/003 345/211
2012/0306840 A1* 12/2012 Han ..... G09G 3/003 345/212
2013/0003269 A1* 1/2013 Kimura ..... G09G 3/3233 361/679.01
2013/0100173 A1* 4/2013 Chaji ..... G09G 5/10 345/690
2014/0354517 A1* 12/2014 Chung ..... G09G 3/3258 345/76
2014/0354522 A1* 12/2014 Chung ..... G09G 3/003 345/82

* cited by examiner

PIXEL AND ORGANIC LIGHT EMITTING DIODE DISPLAY DEVICE USING THE SAME

CROSS-REFERENCE TO RELATED APPLICATIONS

This application claims priority to and the benefit of Korean Patent Application No. 10-2013-0053668, filed on May 13, 2013, in the Korean Intellectual Property Office, the entire contents of which are incorporated herein by reference in their entirety.

BACKGROUND

Field

The disclosed technology generally relates to an organic light emitting diode (OLED) pixel circuit and an OLED display that has improved display qualities and a reduced driving frequency.

Description of the Related Technology

Recently, various flat panel display technologies have been developed which have less weight and volume than traditional bulky and heavy cathode ray tube (CRT) displays. Such flat panel technologies include liquid crystal display, field emission display, plasma display panel, organic light emitting diode display among others.

Among these displays, OLED technology displays images using organic light emitting diodes that generate light by recombining electrons and holes. These displays are characterized by fast response speed and low power consumption.

SUMMARY OF CERTAIN INVENTIVE ASPECTS

One inventive aspect relates to a pixel and an organic light emitting diode display using the same, which can improve display quality.

According to an aspect of the disclosed technology, there is disclosed a pixel including an organic light emitting diode, a first transistor, a storage unit connected to a data line and configured to store a data signal from the data line, a second transistor connected to a fourth node and the first node, and a third transistor connected to the first node and a third node. The first transistor is configured to control the amount of current flowing from a first power source connected via a second node to a second power source via the organic light emitting diode in response to a voltage at a first node. The second transistor is configured to be turned on when a second control signal is supplied. The third transistor is configured to be turned on when a third control signal is supplied.

In another implementation of the pixel, the storage unit includes a first capacitor connected to the fourth node and a fixed voltage source, and a seventh transistor connected to the fourth node and the data line. The seventh transistor is configured to be turned on when a scan signal is supplied.

In another implementation of the pixel, the fixed voltage source has a voltage lower than that of the first power source.

In another implementation of the pixel, the storage unit includes a seventh transistor connected to the fourth node and a fixed voltage source, and a first capacitor connected to the fourth node and the data line. The seventh transistor is configured to be turned on when a scan signal is supplied to a scan line In another implementation of the pixel, turn-on periods of the second and third transistors do not overlap with each other.

In another implementation of the pixel, the pixel further includes a fourth transistor connected to the third node and the data line, and a sixth transistor connected to the first power source and the second node. The fourth transistor is configured to be turned on when a first control signal is supplied. The sixth transistor is configured to be turned off when an emission control signal is supplied and turned on otherwise.

In another implementation of the pixel, a turn-on period of the fourth transistor at least partially overlaps with at least one turn-on period of the second and third transistors.

In another implementation of the pixel, a turn-on period of the sixth transistor at least partially overlaps with a turn-on period of the third transistor.

In another implementation of the pixel, the pixel further includes a fifth transistor connected to an anode electrode of the organic light emitting diode and an initialization power source. The fifth transistor is configured to be turned on when the first control signal is supplied.

In another implementation of the pixel, the initialization power source has a voltage at which the organic light emitting diode is turned off.

In another implementation of the pixel, the pixel further includes a fifth transistor connected to the anode electrode of the organic light emitting diode and the second power source. The fifth transistor is configured to be turned on when the first control signal is supplied.

In another implementation of the pixel, the pixel further includes a fifth transistor connected to the anode electrode of the organic light emitting diode and a sensing line. The fifth transistor is configured to be turned on when the second control signal is supplied.

According to an aspect of the disclosed technology, there is disclosed an organic light emitting diode display, including: a control driver, a scan driver, a data driver, and pixels positioned in an area defined by the scan lines and the data lines. Each pixel is positioned on a horizontal line and includes an organic light emitting diode, a first transistor, a storage unit connected to a data line and configured to store the data signal when a scan signal is supplied to a scan line, a second transistor connected to a fourth node of the storage unit and the first node, and a third transistor connected to the first node and a third node. The control driver is configured to supply a first control signal to a first control line during first and second periods in one frame, supply a second control signal to a second control line during the second period in the one frame, and supply a third control signal to a third control line during the first period and a third period in the one frame. The scan driver is configured to progressively supply a scan signal to scan lines during the third period, and supply an emission control signal to an emission control line during the second period. The data driver is configured to apply a bias voltage to data lines during the first period, apply a reference voltage to the data lines during the second period, and supply a data signal to the data lines so as to be synchronized with the scan signal during the third period. The first transistor is configured to control an amount of current flowing from a first power source connected via a second node to a second power source via the organic light emitting diode in response to a voltage at a first node. The second transistor is configured to be turned on when the second control signal is supplied. The third transistor is configured to be turned on when the third control signal is supplied.

In another implementation of the organic light emitting diode display, the bias voltage has a voltage at which the first transistor is turned off.

In another implementation of the organic light emitting diode display, the reference voltage is configured to be a voltage which is lower than a voltage of the first power source and higher than a voltage of the second power source.

In another implementation of the organic light emitting diode display, the scan driver supplies the emission control signal to the emission control line and the emission control signal overlaps with at least one scan signal during the third period.

In another implementation of the organic light emitting diode display, the storage unit includes a first capacitor connected to the fourth node and a fixed voltage source, and a seventh transistor connected to the fourth node and the data line. The seventh transistor is configured to be turned on when the scan signal is supplied to the i-th scan line.

In another implementation of the organic light emitting diode display, the storage unit includes a seventh transistor connected to the fourth node and a fixed voltage source and a first capacitor connected to the fourth node and the data line. The seventh transistor is configured to be turned on when the scan signal is supplied to the scan line, In another implementation of the organic light emitting diode display, each of the pixels further includes a fourth transistor connected to the third node and the data line, a fifth transistor connected to an anode electrode of the organic light emitting diode and an initialization power source, and a sixth transistor connected to the first power source and the second node. The fourth transistor is configured to be turned on when the first control signal is supplied. The fifth transistor is configured to be turned on when the first control signal is supplied. The sixth transistor is configured to be turned off when the emission control signal is supplied and be turned on when the emission control signal is not supplied.

In another implementation of the organic light emitting diode display, the initialization power source has a voltage at which the organic light emitting diode is turned off.

In another implementation of the organic light emitting diode display, the organic light emitting diode display further includes a fourth transistor connected to the third node and the data line, a fifth transistor connected to the anode electrode of the organic light emitting diode and the second power source, and a sixth transistor connected to the first power source and the second node. The fourth transistor is configured to be turned on when the first control signal. The fifth transistor is configured to be turned on when the first control signal is supplied. The sixth transistor is configured to be turned off when the emission control signal is supplied and be turned on when the emission control signal is not supplied.

In another implementation of the organic light emitting diode display, the fourth transistor has a turn-on period at least partially overlapped with a turn-on period of the second transistor and the third transistor.

In another implementation of the organic light emitting diode display, the sixth transistor has a turn-on period at least partially overlapped with a turn-on period of the third transistor.

In another implementation of the organic light emitting diode display, the initialization power source is set to a voltage at which the organic light emitting diode is turned off.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein. Rather, these embodiments are disclosed so that this disclosed technology will be thorough and complete, and will fully convey the scope of the exemplary embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION OF CERTAIN INVENTIVE EMBODIMENTS

Figure 1:
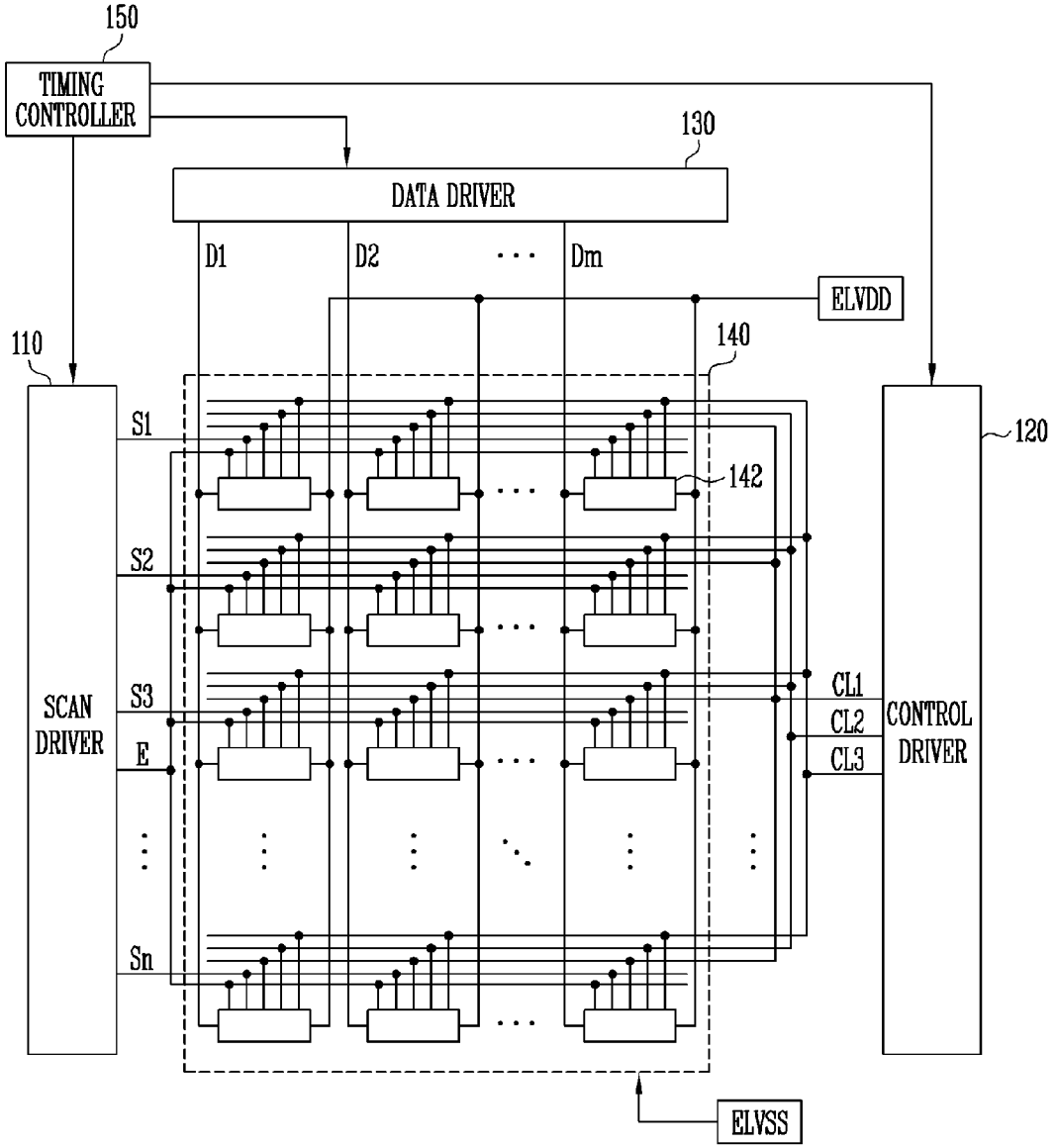
FIG. 1 is a block diagram illustrating an organic light emitting diode display according to an exemplary embodiment of the disclosed technology.

Hereinafter, certain exemplary embodiments according to the disclosed technology will be described with reference to the accompanying drawings, in which exemplary embodiments of the disclosed technology are shown. As those skilled in the art would realize, the described embodiments may be modified in various different ways, all without departing from the spirit or scope of the disclosed technology.

The drawings and description are to be regarded as illustrative in nature and not restrictive. Like reference numerals designate like elements throughout the specification.

Further, since sizes and thicknesses of constituent members shown in the accompanying drawings are arbitrarily given for better understanding and ease of description, the disclosed technology is not limited to the illustrated sizes and thicknesses.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on" another element, it may be directly on the other element or intervening elements may also be present.

In addition, unless explicitly described to the contrary, the word "comprise" and variations such as "comprises" or "comprising" will be understood to imply the inclusion of stated elements but not the exclusion of any other elements. Throughout this specification, it is understood that the term on and similar terms are used generally and are not necessarily related to a gravitational reference.

Here, when a first element is described as being connected to a second element, the first element may be not only directly connected to the second element but may also be indirectly connected to the second element via a third element. Further, some of the elements that are not essential to the complete understanding of the disclosed technology are omitted for clarity. Also, like reference numerals refer to like elements throughout.

In addition, in the accompanying drawings, an organic light emitting diode (OLED) display is illustrated as an active matrix (AM)-type OLED display in a 6Tr-1Cap structure in which six thin film transistors (TFTs) and one capacitor are formed in one pixel, but the disclosed technology is not limited thereto. Therefore, the OLED display may have various structures. For example, a plurality of TFTs and at least one capacitor may be provided in one pixel of the OLED display, and separate wires may be further provided in the OLED display. Here, the pixel refers to a minimum unit for displaying an image, and the OLED display displays an image by using a plurality of pixels.

FIG. 1 is a block diagram illustrating an organic light emitting diode display according to an exemplary embodiment of the disclosed technology.

Referring to FIG. 1, the organic light emitting diode display according to this embodiment includes a pixel unit 140. The pixel unit 140 may include pixels 142, a scan driver 110, a control driver 120, a data driver 130 and a timing controller 150, the control driver 120 and the data driver 130. The pixels 142 is positioned in an area defined by scan lines S1 to Sn and data lines D1 to Dm. The scan driver 110 is configured to drive the scan lines S1 to Sn and an emission control line E. The control driver 120 is configured to drive a first control line CL1, a second control line CL2 and a third control line CL3. The data driver 130 is configured to drive the data lines D1 to Dm. The timing controller 150 is configured to control the scan driver 110.

The scan driver 110 supplies a scan signal to the scan lines S1 to Sn. For example, the scan driver 110 shown in FIG. 3 may progressively supply the scan signal to the scan lines S1 to Sn during a third period T3 in one frame 1F. The scan driver 110 supplies an emission control signal to the emission control line E. The scan lines S1 to Sn and the emission control line E are commonly connected to the pixels 142. In an implementation, the scan driver 110 supplies the emission control signal to the emission control line E during a second period T2 in the frame 1F. The scan signal is supplied from the scan driver 110 and set to a voltage (e.g., a low voltage) at which one or more transistors of the pixels 142 are turned on. The emission control signal is supplied from the scan driver 110 and set to a voltage (e.g., a high voltage) at which the transistors are turned off.

The control driver 120 supplies a first control signal, a second control signal and a third control signal to the first control line CL1, the second control line CL2 and the third control line CL3, respectively. The first control line CL1, the second control line CL2 and the third control line CL3 are commonly connected to the pixels 142. In an implementation, the control driver 120 supplies a first control signal during a first period T1 and the second period of the frame 1F. The control driver 120 supplies the second control signal during the second period T2 of the frame 1F. The control driver 120 supplies the third control signal during the first period T1 and the third period T3 of the frame 1F. In addition, each of the first control signal, the second control signal and the third control signal is set to a voltage (e.g., a low voltage) such that the one or more transistors of the pixels 142 are turned on.

The data driver 130 supplies a bias voltage Vbias to the data lines D1 to Dm during the first period T1 of the frame 1F. The data driver 130 supplies a reference voltage Vref to the data lines D1 to Dm during the second period T2 of the frame 1F. The data driver 130 supplies a data signal to the data lines D1 to Dm so that the data driver 130 is synchronized with the scan signal during the third period T3 of the frame 1F. In addition, the data driver 130 may alternately supply left data signals and right data signals in every frame for a purpose of 3D driving.

The timing controller 150 may control the scan driver 110, the control driver 120 and the data driver 130, corresponding to a synchronization signal. The synchronization signal is supplied from the outside of the organic light emitting diode display.

The pixel unit 140 may include the pixels 142 positioned in the area defined by the scan lines S1 to Sn and the data lines D1 to Dm. Each of the pixels 142 may implement a predetermined gray scale while an amount of current flowing from a first power source ELVDD to a second power source ELVSS via an organic light emitting diode (OLED) is controlled.

Meanwhile, although it has been illustrated in FIG. 1 that the emission control line E is connected to the scan driver 110 and the control lines CL1, CL2 and CL3 are connected to the control driver 120, the disclosed technology is not limited thereto. The emission control line E and the control lines CL1, CL2 and CL3 are connected to various drivers. In an implementation, each of the emission control line E and the control lines CL1, CL2 and CL3 are connected to the scan driver 110.

Figure 2:
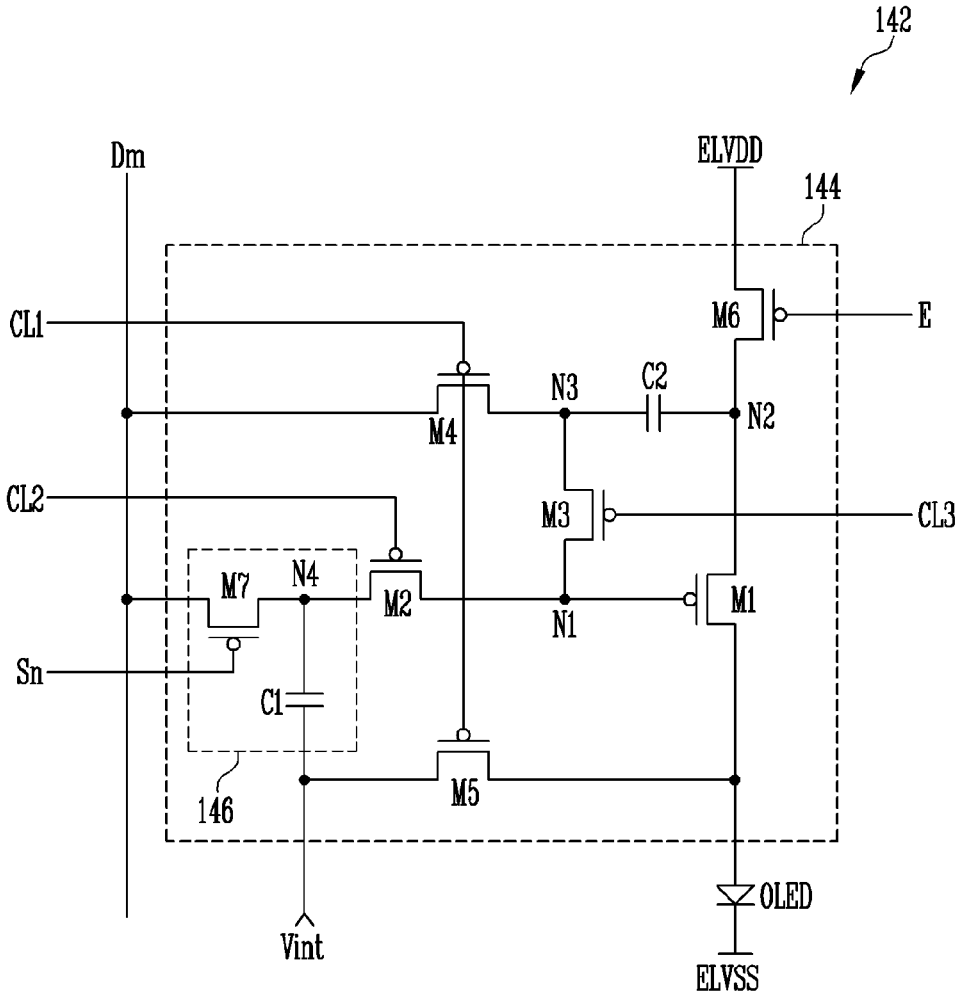
FIG. 2 is a circuit diagram illustrating a pixel according to a first exemplary embodiment of the disclosed technology.

FIG. 2 is a circuit diagram illustrating a pixel according to a first exemplary embodiment of the disclosed technology. A pixel connected to an m-th data line Dm and an n-th scan line Sn is shown in FIG. 2.

Referring to FIG. 2, each of the pixels 142 according to this embodiment may include an organic light emitting diode OLED and a pixel circuit 144. The pixel circuit 144 is configured to control an amount of current supplied to the organic light emitting diode OLED.

An anode electrode of the organic light emitting diode OLED is connected to the pixel circuit 144. A cathode electrode of the organic light emitting diode (OLED) is connected to the second power source ELVSS. The organic light emitting diode (OLED) may generate light with a predetermined luminance, corresponding to an amount of the current supplied from the pixel circuit 144. Meanwhile, the second power source ELVSS is set to a voltage lower than that of the first power source ELVSS so that current may flow through the organic light emitting diode OLED.

The pixel circuit 144 may control an amount of current supplied to the organic light emitting diode OLED in response to a data signal. The pixel circuit 144 may include a first transistor M1, a second transistor M2, a third transistor M3, a fourth transistor M4, a fifth transistor M5, a sixth transistor M6, a storage unit 146 and a second capacitor C2.

A first electrode of the first transistor (i.e., a driving transistor) M1 is connected to a second node N2. A second electrode of the first transistor M1 is connected to the anode electrode of the organic light emitting diode OLED. A gate electrode of the first transistor M1 is connected to a first node N1. The first transistor M1 may control an amount of current flowing from the first power source ELVDD to the second power source ELVDD via the organic light emitting diode OLED in response to a voltage of the first node N1.

A first electrode of the second transistor M2 is connected to a fourth node of the storage unit 146. A second electrode of the second transistor M2 is connected to the first node N1. A gate electrode of the second transistor M2 is connected to the second control line CL2. The second transistor M2 is turned on when the second control signal is supplied to the second control line CL2 such that the first node N1, the second node N2, the third node N3 and the fourth node N4 are electrically connected to each other.

A first electrode of the third transistor M3 is connected to a third node N3. A second electrode of the third transistor M3 is connected to the first node N1. A gate electrode of the third transistor M3 is connected to the third control line CL3. The third transistor M3 is turned on when the third control signal is supplied to the third control line CL3 such that the first node N1, the second node N2 and the third node N3 are electrically connected to each other.

A first electrode of the fourth transistor M4 is connected to the data line Dm. A second electrode of the fourth transistor M4 is connected to the third node N3. A gate electrode of the fourth transistor M4 is connected to the first control line CL1. The fourth transistor M4 is turned on when a first control signal is supplied to the first control line CL1 such that the data line Dm and the third node N3 are electrically connected to each other.

A first electrode of the fifth transistor M5 is connected to the anode electrode of the organic light emitting diode OLED. A second electrode of the fifth transistor M5 is connected to an initialization power source Vint. A gate electrode of the fifth transistor M5 is connected to the first control line CL1. The fifth transistor M5 is turned on when a first control signal is supplied to the first control line CL1 and apply a voltage of the initialization power source Vint to the anode electrode of the organic light emitting diode OLED. In addition, the initialization power source Vint is set to a low voltage so that current from the first transistor M1 may flow via the fifth transistor M5. Thus, in a case where the voltage of the initialization power source Vint is applied to the anode electrode of the organic light emitting diode OLED, the organic light emitting diode OLED is set as a non-emission state.

A first electrode of the sixth transistor M6 is connected to the first power source ELVDD. A second electrode of the sixth transistor M6 is connected to the second node N2. A gate electrode of the sixth transistor M6 is connected to the emission control line E. The sixth transistor M6 is turned off when the emission control signal is supplied to the emission control line E. The sixth transistor M6 is turned on when the emission control signal is not supplied to the emission control line E.

The second capacitor C2 is connected between the second node N2 and the third node N3. The second capacitor C2 may charge a voltage of a data signal and a voltage corresponding to a threshold voltage of the first transistor M1. The data signal is provided from the storage unit 146.

The storage unit 146 may store a voltage in response to the data signal during the third period T3 during which the organic light emitting diode OLED emits light. The storage unit 146 supplies the stored voltage to the first node N1 during the second period T2 during which the organic light emitting diode OLED does not emit light. The storage unit 146 may include a seventh transistor M7 and a first capacitor C1.

A first electrode of the seventh transistor M7 is connected to the data line Dm and a second electrode of the seventh transistor M7 is connected to the fourth node N4. A gate electrode of the seventh electrode M7 is connected to the scan line Sn. The seventh transistor M7 is turned on when the scan signal is supplied to the scan line Sn such that the fourth node N4 and the data line Dm are electrically connected to each other.

The first capacitor C1 is connected between the fourth node N4 and a fixed voltage source. The first capacitor C1 may store a voltage in response to a data signal supplied from the data line Dm during the third period T3. Meanwhile, the fixed voltage source may mean a voltage source that is able to supply a fixed voltage. In an implementation, the fixed voltage source includes the initialization power source Vint.

Figure 3:
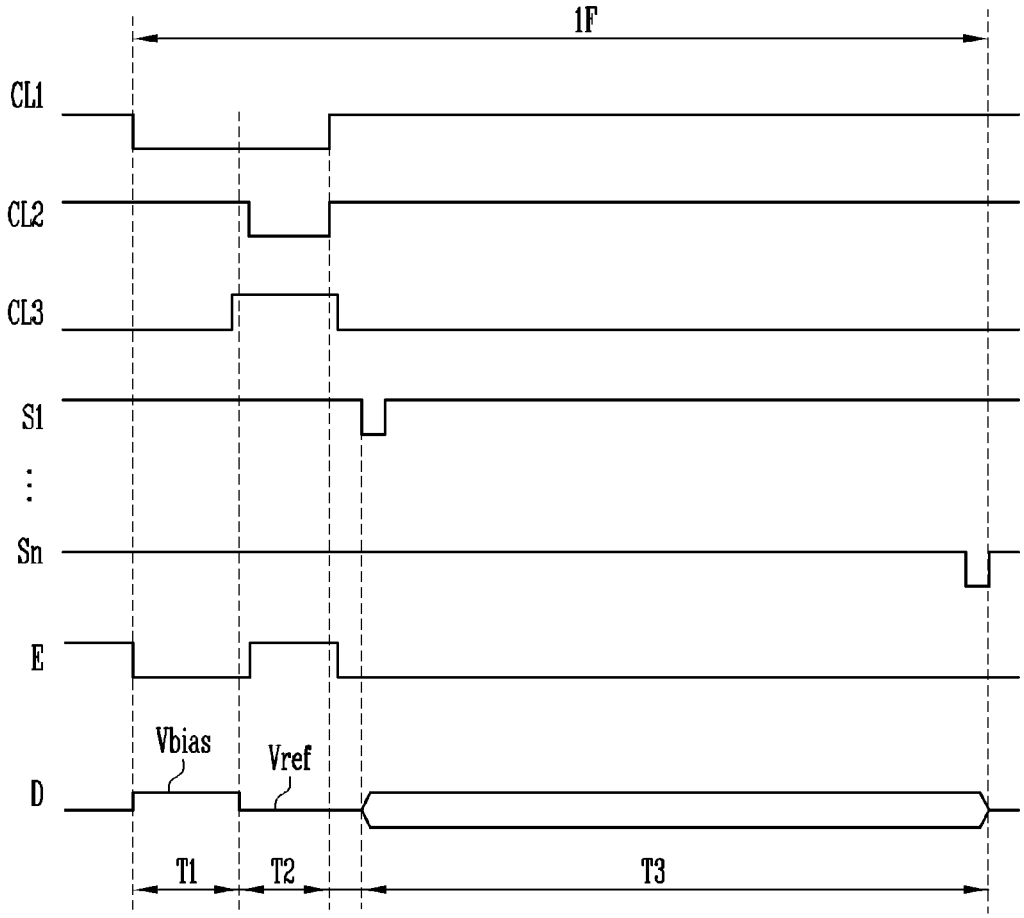
FIG. 3 is a waveform diagram illustrating a driving method of the pixel according to the first exemplary embodiment of the disclosed technology.

FIG. 3 is a waveform diagram illustrating a driving method of the pixel according to the first embodiment of the disclosed technology.

Referring to FIG. 3, the frame 1F according to this embodiment is divided into a first period T1, a second period T2 and a third period T3.

The first period T1 is a period when an off-bias voltage is applied to the first transistor M1. In a case where the off-bias voltage is applied to the first transistor M1, a characteristic curve of the first transistor M1 is initialized and thereby display a uniform image.

The second period T2 is a period when a threshold voltage of the first transistor M1 and a voltage in response to a data signal are charged in the second capacitor C2.

The third period T3 is an emission period during which an amount of current supplied to the organic light emitting diode OLED is controlled in response to a voltage of the second capacitor C2 and a data signal of the current frame is stored in the storage unit 146.

An exemplary operation of the pixel 142 according to this embodiment will be described in detail. At first, a first control signal and a third control signal are supplied to the first control line CL1 and the third control line CL3, respectively, during the first period T1. The bias voltage Vbias is applied to the data line Dm during the first period T1.

If the first control signal is supplied to the first control line CL1, the fourth transistor M4 and the fifth transistor M5 are turned on. If the fourth transistor M4 is turned on, the data line Dm and the third node N3 are electrically connected to each other. Then, the bias voltage Vbias from the data line Dm is applied to the third node N3. If the fifth transistor M5 is turned on, a voltage of the initialization power source Vint is applied to the anode electrode of the organic light emitting diode OLED. If a voltage of the initialization power source Vint is applied to the anode electrode of the organic light emitting diode OLED, current from the first transistor M1 may flow through the initialization power source Vint and accordingly, the organic light emitting diode OLED is set in a non-emission state.

If a third control signal is supplied to the third control line CL3, the first node N1 and the third node N3 are electrically connected to each other. Then, the bias voltage Vbias from the data line Dm is applied to the first node N1. Here, in a case where an off-bias voltage is applied as the bias voltage Vbias, the first transistor M1 is turned off. If the first transistor M1 is turned off, the voltage at the second node N2 is set as a voltage of the first power source ELVDD.

A supply of a first control signal to the first control line CL1 is maintained during the second period T2. During the second period T2, a second control signal is supplied to the second control line CL2 and an emission control signal is supplied to the emission control line E.

If a supply of a first control signal to the first control line CL1 is maintained, the fourth transistor M4 and the fifth transistor M5 may maintain a turn-on state. Thus, a reference voltage Vref is applied to the third node N2 during the second period T2. The reference voltage Vref is applied from the data line Dm. The reference voltage Vref is a voltage at which a gray scale is implemented in addition to a voltage of a data signal. The reference voltage Vref is set to a voltage higher than a voltage of the second power source ELVSS and lower than a voltage of the first power source ELVDD.

If the emission control signal is supplied to the emission control line E, the sixth transistor M6 is turned off. If the sixth transistor M6 is turned off, the first power source ELVDD and the second node N2 are electrically decoupled from each other. If a second control signal is supplied to the second control line CL2, the second transistor M2 is turned on. If the second transistor M2 is turned on, the first node N1 and the fourth node N4 are electrically connected to each other. Then, a voltage of a data signal is applied to the first node N1. The voltage of the data signal is stored in the first capacitor C1.

If a voltage of a data signal is applied to the first node N1, a voltage of the second node N2 may drop from a voltage of the first power source ELVDD to a voltage obtained by adding a absolute threshold voltage of the first transistor M1 to a voltage of the data signal. In this case, the second capacitor C2 may charge a voltage in response to a difference between a voltage of the third node N3 and the voltage of the second node N2. That is, the second capacitor C2 may charge a voltage in response to the voltage of the data signal and the threshold voltage of the first transistor M1 during the second period T2.

Subsequently, during the third period T3, a third control signal is supplied to the third control line CL3 and a scan signal is progressively supplied to the scan lines S1 to Sn. A supply of an emission control signal to the emission control line E is stopped during the third period T3.

If a third control signal is supplied to the third control line CL3, the third transistor M3 is turned on. If the third transistor M3 is turned on, the first node N1 and the third node N3 are electrically connected to each other. In this case, a voltage of the first node N1 is set to be the reference voltage Vref.

If a supply of an emission control signal to the emission control line E is stopped, the sixth transistor M6 is turned on. If the sixth transistor M6 is turned on, a voltage of the first power source ELVDD is applied to the second node N2. In this case, a voltage of the second node N2 is increased to the voltage of the first power source ELVDD from a voltage obtained by adding a absolute threshold voltage of the first transistor M1 to a voltage of a data signal. A voltage of the first node N1 may also increase by coupling of the second capacitor C2. If the sixth transistor M6 is turned on, a voltage of the first node N1 is set as shown in Equation 1.

$$V_{N1}=ELVDD+Vref-Vdata-|VthM1| \quad \text{Equation 1}$$

In Equation 1, Vdata denotes a voltage of a data signal supplied from the first capacitor C1 and VthM1 denotes a threshold voltage of the first transistor M1.

After a voltage obtained by Equation 1 is applied to the first node N1, the first transistor M1 may control an amount of current supplied to the organic light emitting diode OLED in response to a voltage applied to the first node N1. In this case, an amount of current flowing through the organic light emitting diode OLED is set as shown in Equation 2.

$$\begin{aligned} I &= \frac{1}{2}\mu C_{ox}\frac{W}{L}(ELVDD - V_{N1} - |VthM1|)^2 \\ &= \frac{1}{2}\mu C_{ox}\frac{W}{L}(Vdata - Vref)^2 \end{aligned} \quad \text{Equation 2}$$

In Equation 2, μ denotes the mobility of the first transistor M1, $C_{ox}$ denotes the gate capacitance of the first transistor, W and L denote a channel width of the first transistor M1 and a channel length of the first transistor M1, respectively. Referring to Equation 2, a current supplied to the organic light emitting diode OLED is determined regardless of a threshold voltage of the first transistor M1 and a voltage drop of the first power source ELVDD.

Meanwhile, if a scan signal is supplied to the scan line Sn during the third period T3, the seventh transistor M7 is turned on. If the seventh transistor M7 is turned on, a data signal from the data line Dm is supplied to the fourth node N4. Then, the first capacitor C1 may store a voltage in response to a data signal of a current frame such that the first capacitor C1 is synchronized with the scan signal supplied to the scan line Sn. The data signal of the current frame is supplied to the data line. Subsequently, if a supply of the scan signal to the scan line Sn is stopped, the fourth node N4 is set as in a floating state. Thus, the first capacitor C1 may maintain a charged voltage, regardless of a data signal supplied to the data line Dm. In an implementation of the disclosed technology, a predetermined image is implemented by repeating a aforementioned procedure.

Figure 4:
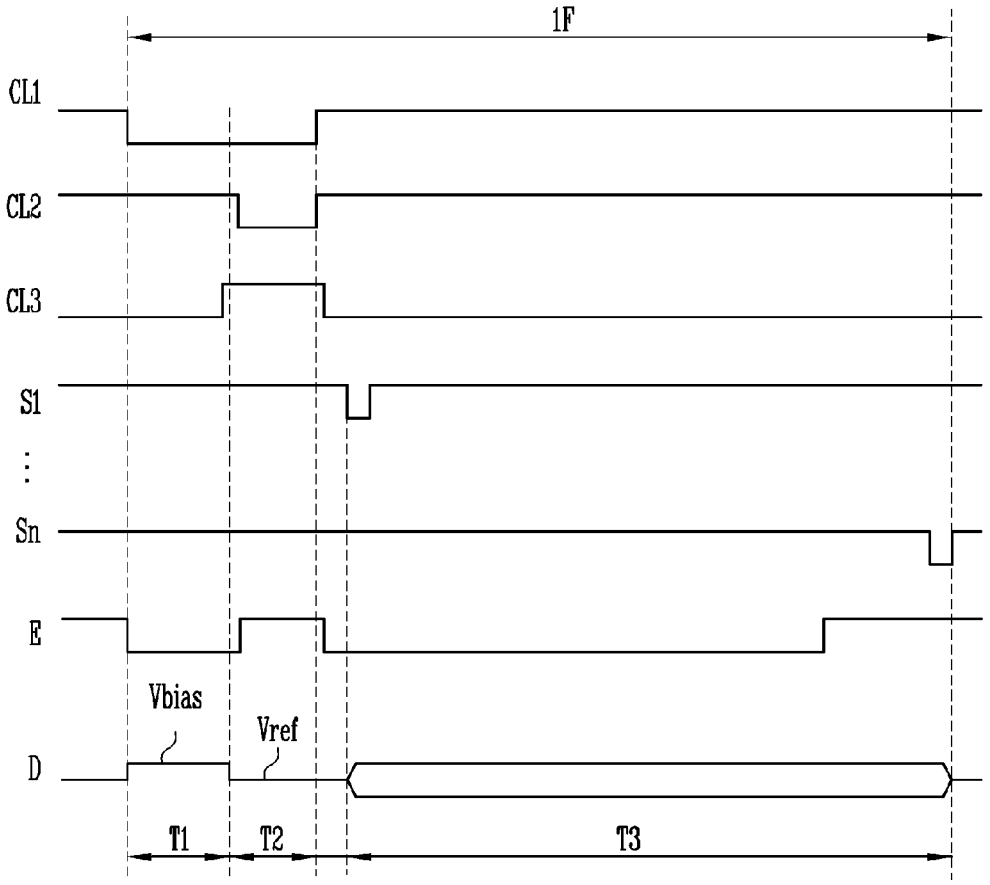
FIG. 4 is a waveform diagram illustrating a driving method of a pixel according to a second exemplary embodiment of the disclosed technology.

FIG. 4 is a waveform diagram illustrating a driving method of a pixel according to a second exemplary embodiment of the disclosed technology. In FIG. 4, the detailed descriptions of components identical to those of FIG. 3 will be omitted.

Referring to FIG. 4, in a driving method according to this embodiment, an emission control signal is supplied to the emission control line E during the third period T3. In other words, the scan driver 110 supplies the emission control signal to the emission control line E such that the scan driver 110 overlaps with at least one scan signal during the third period T3.

If an emission control signal is supplied to the emission control line E, the sixth transistor M6 is turned off. If the sixth transistor M6 is turned off, the first power source ELVDD and the second node N2 are electrically decoupled from each other and the organic light emitting diode OLED is set to be in a non-emission state. That is, in this embodiment, brightness of each of the pixels 142 is additionally controlled by controlling a width of an emission control signal. The emission control signal is supplied to the emission control line E during the third period T3.

Figure 5:
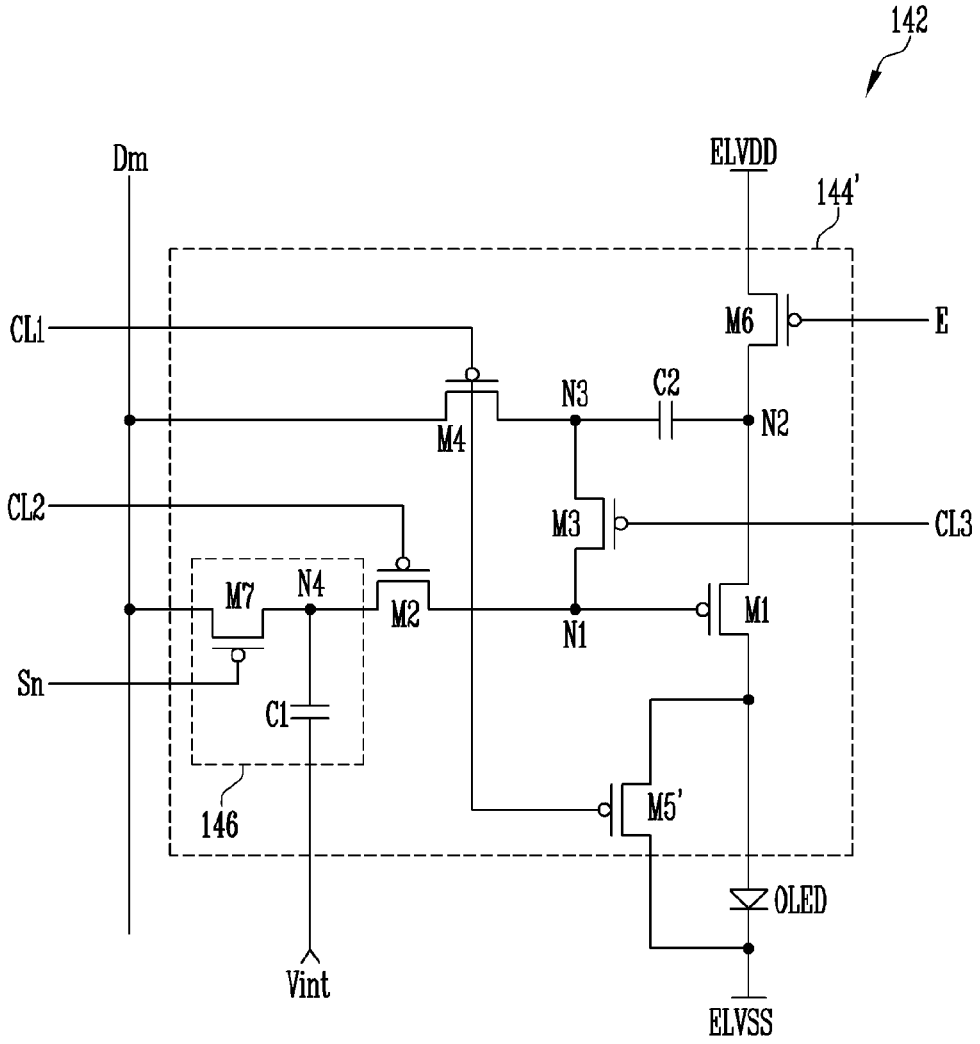
FIG. 5 is a circuit diagram illustrating the pixel according to the second exemplary embodiment of the disclosed technology.

FIG. 5 is a circuit diagram illustrating a pixel according to the second embodiment of the disclosed technology. In FIG. 5, components identical to those of FIG. 2 are designated by like reference numerals, and their detailed descriptions will be omitted.

Referring to FIG. 5, the pixel 142 according to this embodiment includes the organic light emitting diode OLED and a pixel circuit 144'.

The pixel circuit 144' may include a fifth transistor M5' that is connected between the anode electrode of the organic light emitting diode OLED and the second power source ELVSS. A gate electrode of the fifth transistor M5' is connected to the first control line CL1. The fifth transistor M5' is turned on when the first control signal is supplied to the first control line CL1 such that the fifth transistor M5' may apply a voltage of the second power source ELVSS to the anode electrode of the organic light emitting diode OLED. In this case, current supplied via the first transistor M1 is supplied to the second power source ELVSS by not passing through the organic light emitting diode OLED but passing through the fifth transistor M5' during a period when the fifth transistor M5' is turned on. Thus, the organic light emitting diode OLED is set as in the non-emission state during a period when the first control signal is supplied.

A substantial operation of the pixel according to this embodiment is identical to that of a pixel according to the first embodiment, except that only a position of the fifth transistor M5' is changed.

Figure 6:
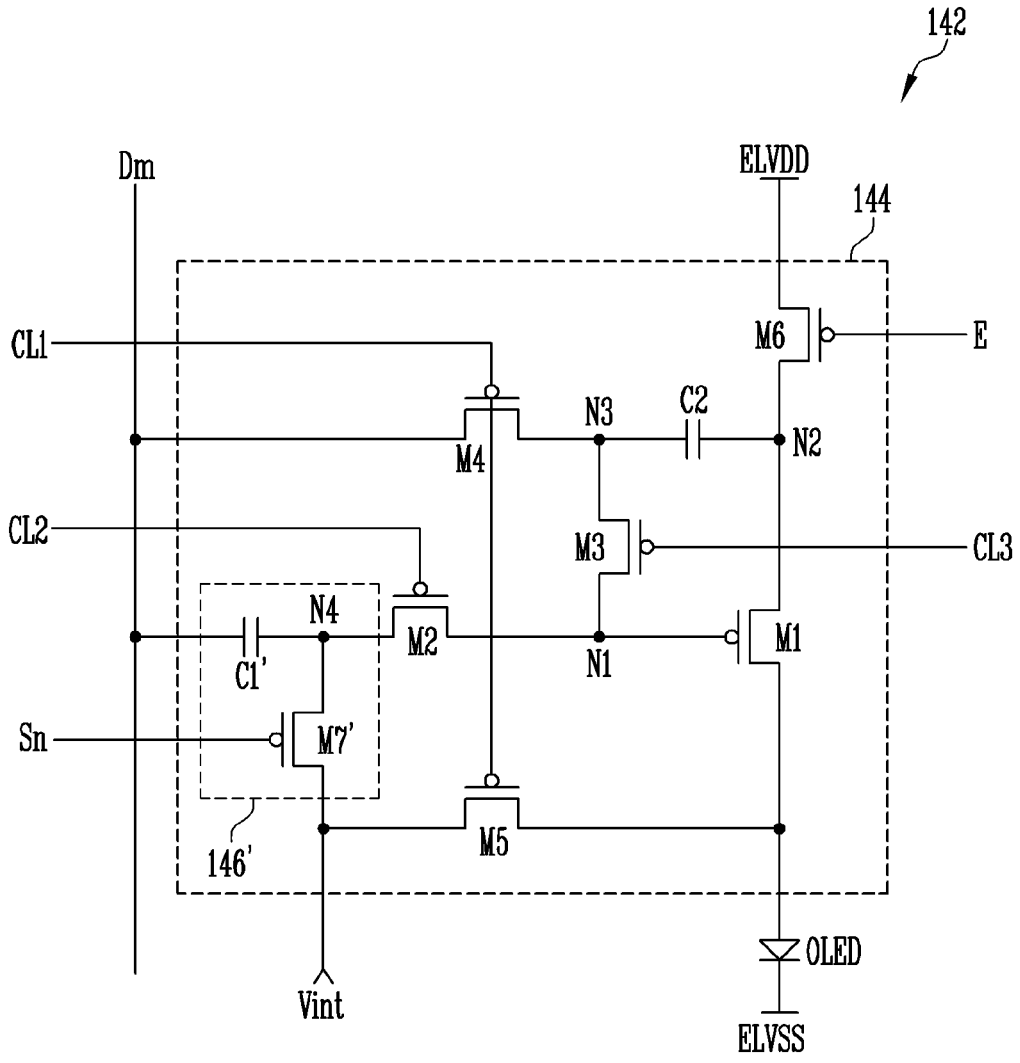
FIG. 6 is a circuit diagram illustrating a pixel according to a third exemplary embodiment of the disclosed technology.

FIG. 6 is a circuit diagram illustrating a pixel according to a third exemplary embodiment of the disclosed technology. In FIG. 6, components identical to those of FIG. 2 are designated by like reference numerals, and their detailed descriptions will be omitted.

Referring to FIG. 6, a storage unit 146' in the pixel 142 according to this embodiment includes a first capacitor C1' and a seventh transistor M7'.

The seventh transistor M7' is connected to the fourth node N4 and the fixed voltage source (e.g., the initialization power source Vint). A gate electrode of the seventh transistor M7' is connected to the scan line Sn. The seventh transistor M7' is turned on when the scan signal is supplied to the scan line Sn such that the seventh transistor M7' may apply a voltage of the initialization power source Vint to the fourth node N4.

The first capacitor C1' is connected to the fourth node N4 and the data line Dm. The first capacitor C1' may store a voltage corresponding to a difference between a voltage of the data signal supplied to the data line Dm and a voltage of the initialization power source Vint during a period when the seventh transistor M7' is turned on.

An exemplary operation of the pixel 142 according to this embodiment will be described in conjunction with FIGS. 3 and 6. At first, the first control signal and the third control signal are supplied to the first control line CL1 and the third control line CL3, respectively, during the first period T1. In addition, the bias voltage Vbias is supplied to the data line Dm during the first period T1.

If a third control signal is supplied to the third control line CL3, the third transistor M3 is turned on and the first node N1 and the third node N1 are electrically connected to each other. If a first control signal is supplied to the first control line CL1, the fourth transistor M4 and the fifth transistor M5 are turned on.

If the fourth transistor M4 is turned on, the bias voltage Vbias from the data line Dm is applied to the first node N1 via the third node N3. Here, if an off-bias voltage is applied as the bias voltage Vbias, the first transistor M1 is turned off. If the first transistor M1 is turned off, the voltage at the second node N2 is set as a voltage of the first power source ELVDD.

If the fifth transistor M5 is turned on, a voltage of the initialization power source Vint is applied to the anode electrode of the organic light emitting diode OLED. If a voltage of the initialization power source Vint is applied to the anode electrode of the organic light emitting diode OLED, current from the first transistor M1 may flow through the initialization power source Vint and the organic light emitting diode OLED is set as in a non-emission state.

A supply of a first control signal to the first control line CL1 is maintained during the second period T2. During the second period T2, a second control signal is supplied to the second control line CL2 and an emission control signal is supplied to the emission control line E.

If a supply of a first control signal to the first control line CL1 is maintained, the fourth transistor M4 and the fifth transistor M5 may maintain a turn-on state. Thus, the reference voltage Vref from the data line Dm is applied to the third node N3 during the second period T2.

If an emission control signal is supplied to the emission control line E, the sixth transistor M6 is turned off. If the sixth transistor M6 is turned off, the first power source ELVDD and the second node N2 are electrically decoupled from each other. If a second control signal is supplied to the second control line CL2, the second transistor M2 is turned on. If the second transistor M2 is turned on, the first node N1 and the fourth node N4 are electrically connected to each other.

In this case, a voltage of Vint−Vdata+Vref is applied to the first node N1, corresponding to the reference voltage Vref applied to the data line Dm. Here, the Vdata may mean a voltage of a data signal supplied in a previous period and stored in the first capacitor C1.

If the voltage of Vint−Vdata+Vref is applied to the first node N1, the voltage at the second node N2 is dropped from a voltage of the first power source ELVDD to a voltage obtained by adding the absolute threshold voltage of the first transistor M1 to the voltage at the first node N1. In this case, the second capacitor C2 may charge a voltage corresponding to a difference between a voltage of the third node N3 and a voltage of the second node N2. That is, the second capacitor C2 may charge a voltage in response to a voltage of a data signal and a threshold voltage of the first transistor M1 during the second period T2.

Subsequently, during the third period T3, a third control signal is supplied to the third control line CL3 and a scan signal is progressively supplied to the scan lines S1 to Sn. The supply of an emission control signal to the emission control line E is stopped during the third period T3.

If the third control signal is supplied to the third control line CL3, the third transistor M3 is turned on and a voltage of the first node N1 is set as the reference voltage Vref.

If a supply of an emission control signal to the emission control line E is stopped, the sixth transistor M6 is turned on. If the sixth transistor M6 is turned on, a voltage of the first power source ELVDD is applied to the second node N2. In this case, a voltage of the second node N2 may increase to a voltage of the first power source ELVDD and a voltage at the first node N1 may also increase by coupling of the second capacitor C2. If the sixth transistor M6 is turned on, a voltage of the first node N1 is set as shown in Equation 3.

$$V_{N1}=ELVDD+V\text{data}-V\text{int}-|VthM1| \quad \text{Equation 3}$$

After a voltage obtained by Equation 3 is applied to the first node N1, the first transistor M1 may control an amount of current supplied to the organic light emitting diode OLED in response to a voltage applied to the first node N1. In this case, the amount of the current flowing through the organic light emitting diode OLED is set as shown in Equation 4.

$$\begin{aligned} I &= \frac{1}{2}\mu C_{ox}\frac{W}{L}(ELVDD - V_{N1} - |VthM1|)^2 \\ &= \frac{1}{2}\mu C_{ox}\frac{W}{L}(Vint - Vdata)^2 \end{aligned} \quad \text{Equation 4}$$

In Equation 4, μ denotes mobility of the first transistor M1, $C_{ox}$ denotes a gate capacitance of the first transistor, W and L denote a channel width of the first transistor M1 and a channel length of the first transistor M1, respectively. Referring to Equation 4, current supplied to the organic light emitting diode OLED is determined regardless of a threshold voltage of the first transistor M1 and a voltage drop of the first power source ELVDD.

Meanwhile, if the scan signal is supplied to the scan line Sn during the third period T3, the seventh transistor M7' is turned on. If the seventh transistor M7' is turned on, the voltage of the initialization power source Vint is applied to the fourth node N4. Then, the first capacitor C1' may store a voltage corresponding to a difference between a voltage of the initialization power source Vint and a voltage of a data signal of a current frame such that the first capacitor C1' is synchronized with a scan signal supplied to the scan line Sn. The voltage of the data signal of the current frame is supplied to the data line Dm. Subsequently, if a supply of a scan signal to the scan line Sn stops, the fourth node N4 is set as in a floating state. Thus, the first capacitor C1' may maintain a charged voltage, regardless of a data signal supplied to the data line Dm. In an exemplary implementation of the disclosed technology, a predetermined image is implemented by repeating the aforementioned procedure.

Figure 7:
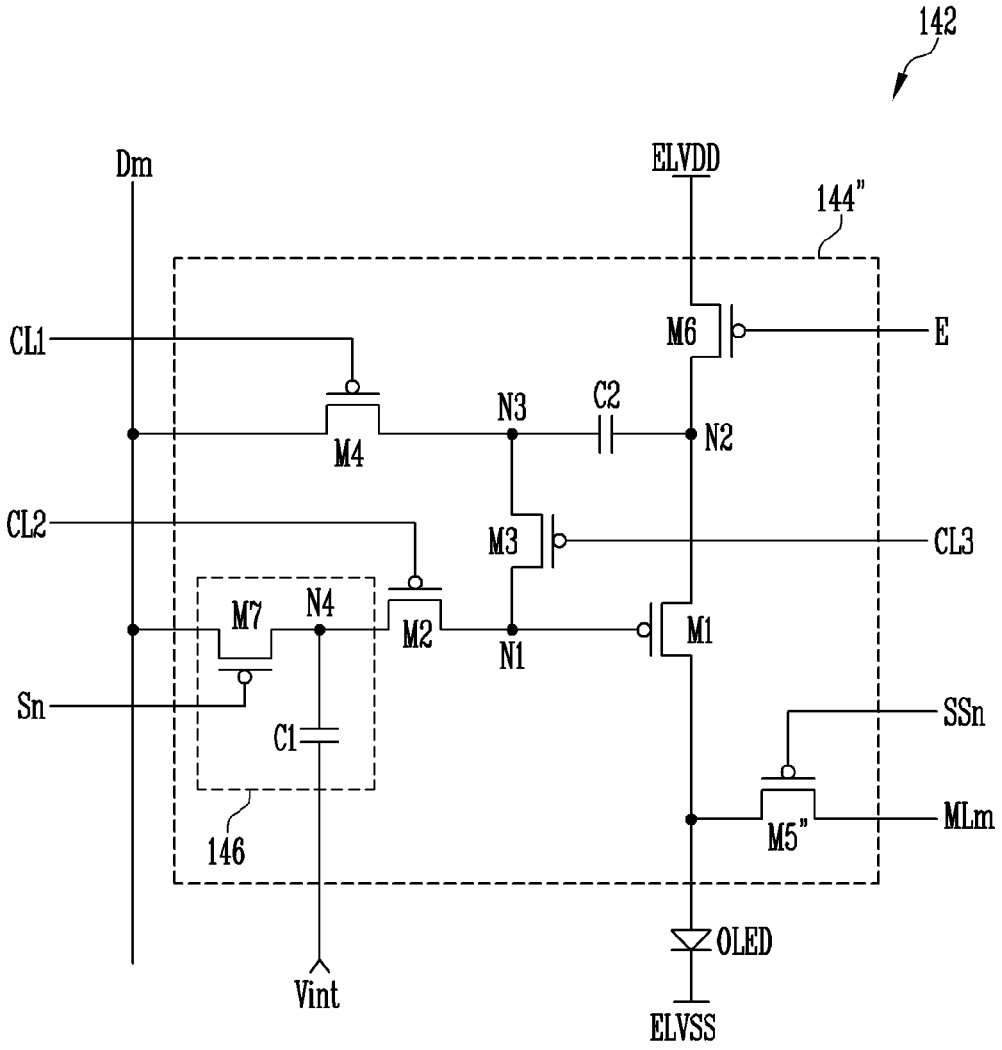
FIG. 7 is a circuit diagram illustrating a pixel according to a fourth exemplary embodiment of the disclosed technology.

FIG. 7 is a circuit diagram illustrating a pixel according to a fourth embodiment of the disclosed technology. In FIG. 7, components identical to those of FIG. 2 are designated by like reference numerals, and their detailed descriptions will be omitted.

Referring to FIG. 7, the pixel 142 according to this embodiment includes a pixel circuit 144" and the organic light emitting diode OLED.

The pixel circuit 144" includes a fifth transistor M5" connected between a sensing line MLm and the anode electrode of the organic light emitting diode OLED. The fifth transistor M5" is turned on when a scan signal is supplied to a second scan line SSn so as to allow the sensing line MLm and the anode electrode of the organic light emitting diode OLED to be electrically connected to each other.

Here, a waveform identical to that of the first control signal shown in FIG. 3 is supplied to the second scan line SSn during a period when the pixel is normally driven. In other words, a second scan signal is supplied to the second scan line SSn during the first and second periods T1 and T2 so that a fifth transistor M5" is turned on. The voltage of the initialization power source Vint is applied to the sensing line MLm during a period when the pixel is normally driven. In this case, the pixel of this embodiment is driven identically to the pixel of the first embodiment.

Additionally, in this embodiment, a second scan signal is supplied to the second scan line SSn in order to extract degradation information of the organic light emitting diode OLED during a separate sensing period. If the second scan signal is supplied to the second scan line SSn during the sensing period, the fifth transistor M5" is turned on. If the fifth transistor M5" is turned on, predetermined current from the sensing line MLm is supplied to the organic light emitting diode OLED. In this case, a voltage is provided as the degradation information of the organic light emitting diode OLED to an external extraction unit (not shown) via the sensing line MLm. The voltage is applied to the organic light emitting diode OLED.

That is, in this embodiment, a substantial operation of the pixel is identical to that of a pixel according to the first embodiment, except that a configuration for extracting degradation information of an organic light emitting diode, which is generally known in the art, is merely used.

Figure 8:
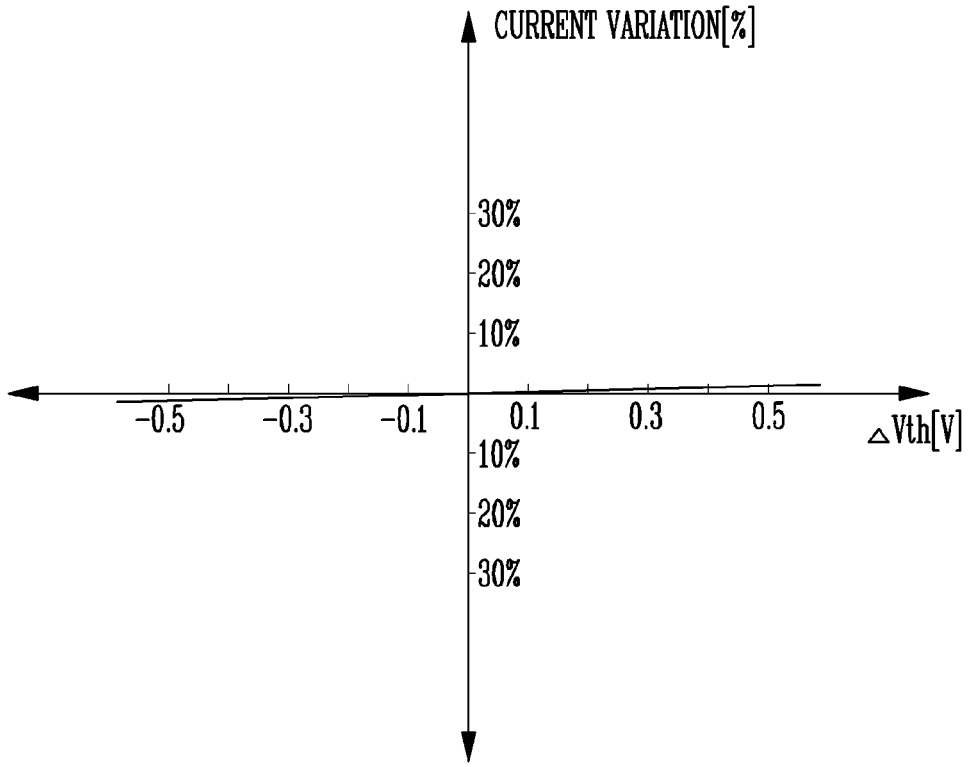
FIG. 8 is a view illustrating a simulation result using the pixel according to the first exemplary embodiment of the disclosed technology.

FIG. 8 is a view illustrating a simulation result using a pixel according to the first embodiment of the disclosed technology.

Referring to FIG. 8, a pixel according to the first embodiment has a current variation of about −1.1% to 1.3% when a threshold voltage of the first transistor M1 is changed from −0.5V to 0.5V. That is, in an exemplary implementation of the disclosed technology, although a threshold voltage of the first transistor M1 is changed, the pixel has the minimum current variation and thereby the pixel displays an image with a desired luminance.

Meanwhile, although it has been described in the disclosed technology that the transistors are shown as PMOS transistors for convenience of illustration, the disclosed technology is not limited thereto. In other words, the transistors is formed as NMOS transistors.

In the disclosed technology, the organic light emitting diode OLED generates light of a specific color, corresponding to the amount of current supplied from the driving transistor. However, the disclosed technology is not limited thereto. In an implementation, the organic light emitting diode OLED may generate white light, corresponding to the amount of the current supplied from the driving transistor. In this case, a color image is implemented using a separate color filter or the like.

By way of summation and review, an organic light emitting diode display includes a plurality of pixels arranged in a matrix form at intersection portions of a plurality of data lines, a plurality of scan lines and a plurality of power lines. Each pixel generally includes an organic light emitting diode, two or more transistors including a driving transistor, and one or more capacitors.

The organic light emitting diode display has low power consumption. However, the amount of current flowing through the organic light emitting diode depending on a variation in threshold voltage of the driving transistor included in each pixel, and therefore, display inequality is caused. That is, the characteristic of the driving transistor is changed depending on manufacturing process variables of the driving transistor included in each pixel. Practically, the manufacturing of the organic light emitting diode display so that all the transistors have the same characteristic are impossible in the current process conditions. Accordingly, there occurs a variation in threshold voltage of the driving transistor.

In order to solve such a problem, there has been proposed a method of adding, to each pixel, a compensation circuit including a plurality of transistor and a capacitor. The compensation circuit included in each pixel charges a voltage corresponding to the threshold voltage of a driving transistor during one horizontal period, and accordingly, a variation in the threshold voltage of the driving transistor is compensated.

Meanwhile, a method has recently been required, in which the compensation circuit is driven at a driving frequency of 240 Hz or more in order to prevent a motion blur phenomenon and/or to implement 3D images. However, in a case where the compensation circuit is driven at a high frequency of 240 Hz or more, the period required to charge the threshold voltage of the driving transistor is shortened, and therefore, it is impossible to compensate for the threshold voltage of the driving transistor.

In the pixel and the organic light emitting diode display using the same according to the disclosed technology, the pixels commonly compensate for the threshold voltage so that it is possible to sufficiently secure the compensation period of the threshold voltage and thereby improve display quality. Further, in the disclosed technology, it is possible to display an image with a desired luminance, regardless of a voltage drop of the first power source. Furthermore, in the disclosed technology, a data signal is stored in a period when the pixels emit light. Therefore, a driving frequency of the organic light emitting diode display is reduced.

For purposes of summarizing the disclosed technology, certain aspects, advantages and novel features of the disclosed technology have been described herein. It is to be understood that not necessarily all such advantages are achieved in accordance with any particular embodiment of the disclosed technology. Thus, the disclosed technology may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the disclosed technology. Thus, the disclosed technology is not intended to be limited to the embodiments shown herein but is to be accorded the widest scope consistent with the principles and novel features disclosed herein.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the disclosed technology as set forth in the following claims.

What is claimed is:

1. An organic light emitting diode (OLED) pixel circuit for an organic light emitting diode display, the pixel comprising:

an organic light emitting diode;

a first transistor configured to control the amount of current flowing from a first power source to a second power source in response to a voltage at a first node, the first transistor connected to the first node, a second node and the organic light emitting diode, and the organic light emitting diode connected to the second power source;

a storage unit connected to a data line and configured to store a data signal from the data line, wherein the storage unit includes:

a first capacitor connected to a fourth node and a fixed voltage source, the fixed voltage source supplying a fixed voltage throughout a frame; and a seventh transistor connected to the fourth node and the data line, the seventh transistor connected to a scan signal line;

a second transistor connected to the fourth node and the first node, the second transistor connected to a second control signal line;

a third transistor connected to the first node and a third node, the third transistor connected to a third control signal line;

a second capacitor connected to the second node and the third node;

a fourth transistor connected to the third node and the data line, the fourth transistor connected to a first control signal line; and a sixth transistor connected to the first power source and the second node, the sixth transistor connected to an emission control signal line.

2. The pixel circuit of claim 1, wherein a voltage of the fixed voltage source is lower than a voltage of the first power source.

3. The pixel circuit of claim 1, wherein turn-on periods of at least one of the second transistor and the third transistor do not overlap with each other.

4. The pixel circuit of claim 1, wherein the fourth transistor has a turn-on period at least partially overlapped with a turn-on period of the second transistor and the third transistor.

5. The pixel circuit of claim 1, wherein the sixth transistor has a turn-on period at least partially overlapped with a turn-on period of the third transistor.

6. The pixel circuit of claim 1, further comprising a fifth transistor connected to the anode electrode of the organic light emitting diode and the second power source, the fifth transistor connected to the first control signal line.

7. The pixel circuit of claim 1, further comprising a fifth transistor connected to the anode electrode of the organic light emitting diode and a sensing line, the fifth transistor connected to the second control signal line, the sensing line extracting degradation information of the organic light emitting diode.

8. The pixel circuit of claim 1, further comprising a fifth transistor connected to an anode electrode of the organic light emitting diode and an initialization power source, the fifth transistor connected to the first control signal line.

9. The pixel circuit of claim 8, wherein the initialization power source is set to a voltage at which the organic light emitting diode is turned off.

10. An organic light emitting diode display, comprising:

a control driver configured to output a first control signal voltage level to a first control line during a first period and a second period of one frame, output a second control signal voltage level to a second control line during the second period, and output a third control signal voltage level to a third control line during the first period and a third period;

a scan driver configured to progressively output a scan signal voltage level to scan lines during the third period, and output an emission control signal voltage level to an emission control line during the second period;

a data driver configured to output a bias voltage to data lines during the first period, output a reference voltage to the data lines during the second period, and output a data signal to the data lines so that the data driver is synchronized with the scan signal during the third period; and pixels positioned in a matrix of locations corresponding to intersections of the scan lines and the data lines, the data lines perpendicular to the scan lines, wherein each of the pixels positioned on a horizontal line includes:

an organic light emitting diode;

a first transistor configured to control the amount of current flowing from a first power source to a second power source in response to a voltage at a first node, the first transistor connected to the first node, the organic light emitting diode and a second node, and the organic light emitting diode connected to the second power source;

a storage unit connected to a data line and configured to store the data signal, the storage unit connected to a scan signal line, wherein the storage unit includes:

a first capacitor connected to a fourth node and a fixed voltage source, the fixed voltage source supplying a fixed voltage throughout a frame; and a seventh transistor connected to the fourth node and the data line, the seventh transistor connected to the scan signal line;

a second transistor connected to the fourth node of the storage unit and the first node, the second transistor connected to the second control signal line;

a third transistor connected to the first node and a third node, the third transistor connected to the third control signal line;

a second capacitor connected to the second and third nodes a fourth transistor connected to the third node and the data line, the fourth transistor connected to a first control signal line; and a sixth transistor connected to the first power source and the second node, the sixth transistor connected to an emission control signal line.

11. The organic light emitting diode display of claim 10, wherein the bias voltage is set as a voltage at which the first transistor is turned off.

12. The organic light emitting diode display of claim 10, wherein the reference voltage is set as a voltage lower than a voltage of the first power source and higher than that of the second power source.

13. The organic light emitting diode display of claim 10, wherein the scan driver is configured to supply the emission control signal to the emission control line so that the emission control signal overlaps with at least one scan signal during the third period.

14. The organic light emitting diode display of claim 10, wherein each pixel further includes a fifth transistor connected to an anode electrode of the organic light emitting diode and an initialization power source, the fifth transistor connected to the first control signal line.

15. The organic light emitting diode display of claim 14, wherein the initialization power source is set to a voltage at which the organic light emitting diode is turned off.

16. The organic light emitting diode display of claim 10, further comprising a fifth transistor connected to the anode electrode of the organic light emitting diode and the second power source, the fifth transistor connected to the first control signal line.

17. The organic light emitting diode display of claim 16, wherein the initialization power source is set to a voltage at which the organic light emitting diode is turned off.

18. An organic light emitting diode (OLED) pixel circuit for an organic light emitting diode display, the pixel comprising:

an organic light emitting diode;

a first transistor configured to control the amount of current flowing from a first power source to a second power source in response to a voltage at a first node, the first transistor connected to the first node, a second node and the organic light emitting diode, and the organic light emitting diode connected to the second power source;

a storage unit connected to a data line and configured to store a data signal from the data line, wherein the storage unit includes:

a first capacitor connected to a fourth node and the data line; and a seventh transistor connected to the fourth node and a fixed voltage source, the fixed voltage source supplying a fixed voltage throughout a frame, the seventh transistor connected to a scan signal line;

a second transistor connected to the fourth node and the first node, the second transistor connected to a second control signal line;

a third transistor connected to the first node and a third node, the third transistor connected to a third control signal line;

a second capacitor connected to the second node and the third node;

a fourth transistor connected to the third node and the data line, the fourth transistor connected to a first control signal line; and a sixth transistor connected to the first power source and the second node, the sixth transistor connected to an emission control signal line.

* * * * *